United States Patent [19]

Polanin

[11] 4,129,219

[45] Dec. 12, 1978

[54] RAILWAY CAR COUPLER

[75] Inventor: Walter R. Polanin, Hazelcrest, Ill.

[73] Assignee: AMSTED Industries Incorporated, Chicago, Ill.

[21] Appl. No.: 584,875

[22] Filed: Jun. 9, 1975

[51] Int. Cl.[2] ..... B61G 3/04

[52] U.S. Cl. ..... 213/100 R; 213/153

[58] Field of Search ..... 213/153, 100 R, 100 W

[56] References Cited

U.S. PATENT DOCUMENTS

| | | | |
|---|---|---|---|
| 3,606,032 | 9/1971 | De Penti | 213/153 X |
| 3,637,089 | 1/1972 | Jwuc et al. | 213/153 |

*Primary Examiner*—Robert B. Reeves
*Assistant Examiner*—John P. Shannon
*Attorney, Agent, or Firm*—Fred P. Kostka

[57] ABSTRACT

The head portion of a railway car coupler is provided with forwardly projecting horizontal upper and lower shelves. The leading edge of the top shelf is angled upwardly and rearwardly to provide clearance for coupler droop. Additionally, the leading angle of the coupler can be extended upwardly to establish an improved relation between the leading edges of the mating couplers, thereby minimizing the tendency to have one leading edge slipping under the other during a droop condition of the couplers.

2 Claims, 7 Drawing Figures

RAILWAY CAR COUPLER

BACKGROUND OF THE INVENTION

The Association of American Railroad (A.A.R.) recognizes various types of standard designed couplers. One of type, designated "F" by the A.A.R., has two interlocking lugs which prevent vertical movement between two engaged type "F" couplers. These lugs also prevent a pulled-out type "F" coupler which is engaged with another type "F" coupler from falling to the road bed. Engaged A.A.R. standard type "F" couplers are prevented from moving vertically relative to each other by the engagement of the guard nose in the interlocking wing pocket. The presence of a lower support shelf and an auxiliary interlocking lug that engages that shelf of an adjacent type "F" coupler further prevents vertical movement of the two engaged type "F" couplers relative to each other. However, the interlocking lugs on the type "F" coupler limit horizontal angling of mated "F" type couplers to a maximum of 3° 45 minutes and further limit vertical angling to a maximum of 2°.

Another design of knuckle type coupler which is recognized by the A.A.R. is the type "E" coupler. The type "E" coupler does not have interlocking lugs similar to those provided on the type "F" coupler. Advantageously, mated type "E" couplers are capable of greater horizontal and vertical angling than the type "F" couplers, and under A.A.R. standards the "E" couplers may be horizontally angled at 13° 30′ and vertically angled at 4° 43′ . The basic "E" coupler does not have interlocking features similar to those provided for on the type "F" coupler and a pulled-out type "E" coupler in engagement with another type "E" coupler will fall to the road bed. Heretofore, it has been proposed to retain such couplers from separating vertically by the provision of one or more support shelves on both the "E" and "F" type couplers. The lower support shelf prevents a mating pulled-out coupler of either design from dropping to the road bed. The lower shelf design for type "F" couplers is now an A.A.R. standard in the United States, while the lower shelf design for type "E" couplers is also in common commercial use in interchange in the United States. Equipping an "E" type coupler head with an upper support shelf above the knuckle in addition to the lower support shelf below the knuckle offers maximum protection to the car and prevents vertical passing in either direction of a mated knuckle-type coupler. The double shelf coupler will further support or be supported by an adjacent knuckle-type coupler in instances where one of the couplers is pulled-out. Difficulty may also be encountered by interference between the leading edges of the upper shelves when angling takes place, particularly as the top shelves may approach each other sooner than desired due to coupler droop caused by wear in keys, wearplates, key slots and the like. At this coupler droop position and maximum vertical angling, the top surface of the leading edges of the upper shelf contact before contact is made between the front face of the couplers and knuckles, thereby imposing the initial heavy buff loads on the shelf.

SUMMARY OF THE INVENTION

In order to overcome these difficulties, the applicant has provided a new and improved railway coupler head which offers the maximum protection to the car equipped with an "E" type coupler regardless of design of the mating knuckle type coupler, while providing for maximum vertical angling irrespective of coupler droop. According to the present invention, an "E" type coupler having an upper and lower shelf is provided wth the leading edges of the upper shelves angled upwardly and rearwardly toward the car. Thus, when the upper shelves approach each other sooner than desired due to coupler droop, the leading edges of the upper shelf will not contact each other before contact is made between the front face of the couplers and knuckles.

Moreover, in accordance with another feature of the present invention, the leading angled edge of the upper shelf is extended upwardly to establish an improved relation between the leading edges of the mating couplers and thereby minimizing the tendency of one leading edge slipping under the other during a droop condition of the couplers.

. DETAILED DESCRIPTION OF THE DRAWINGS

Figure 1:
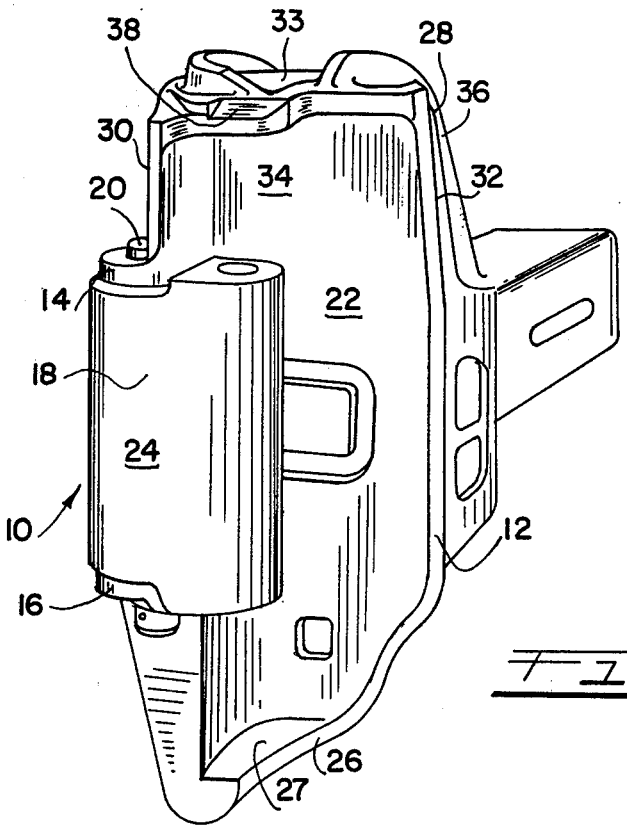
FIG. 1 is a perspective view of a modified type "E" coupler having an upper support shelf of a configuration according to the present invention.
Figure 2:
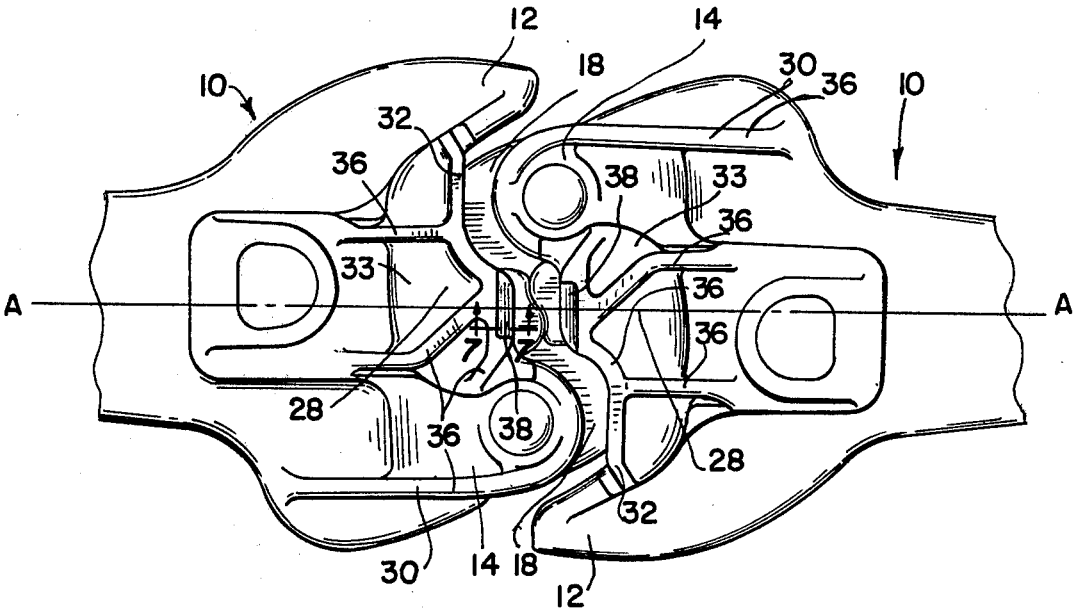
FIG. 2 is a plan view of a pair of mated coupler heads according to the present invention.

FIGS. 1 and 2 illustrate a type "E" coupler 10 having, on one side, a forwardly projecting guard arm 12. A pair of vertically spaced forwardly projecting top and bottom knuckle pivot lugs 14 and 16 are located on the opposite forward side of coupler 10. A knuckle 18 is disposed between the lugs 14 and 16 and is pivotally connected thereto by a pin 20 for rotation about a vertical axis. The guard arm 12 and the knuckle pivot lugs 14 and 16 are transversely spaced to define therebetween a front face 22 adapted to receive a nose portion 24 of the knuckle 18 of a mating coupler.

The coupler 10 is provided with a generally transversely extending horizontal bottom shelf 26 which is disposed directly under face 22. A surface 27 on shelf 26 extends generally perpendicular relative to the vertical portion of the face 22 so that the surface 27 will close a portion on the lower end of the face cavity. and offer support for a knuckle 18 of a mating knuckle which is received within the face area.

There is also provided a generally transversely extending horizontal top shelf 28 disposed directly above face 22. The shelf 28 may either be integrally cast with coupler 10 or may be a weldment secured to the upper portion of the coupler. The shelf 28 has a leading edge 38 and further is defined by a side wall 30 extending from a forwardly projecting lug 14, a side wall 32 extending from the guard arm 12, a top wall 33 and a back wall 34 interconnecting walls, 30, 32 and 33. The wall 30, 32, 33 and 34 may be integral with one another and have no definite starting or termination points and form in the nature of an enclosure. If desired, reinforcement ribs 36 may be secured to top shelf 28 to strengthen the shelf 28.

The bottom shelf 26 and top shelf 28 are arranged to permit the passage on one side of each a similar lower shelf and upper shelf of either a "E" type or "F" type coupler, as illustrated in FIG. 2.

Figure 3:
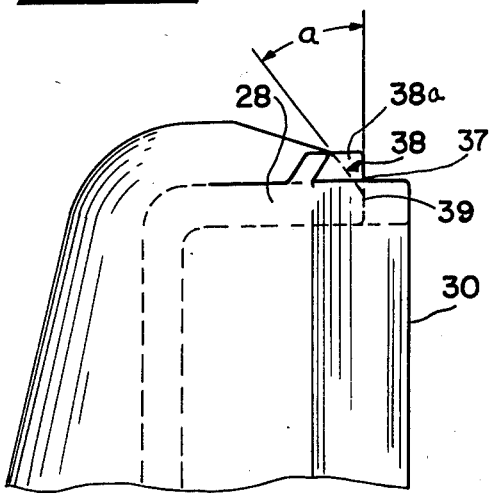
FIG. 3 is a fragmentary side view of the coupler head of FIG. 1.
Figure 4:
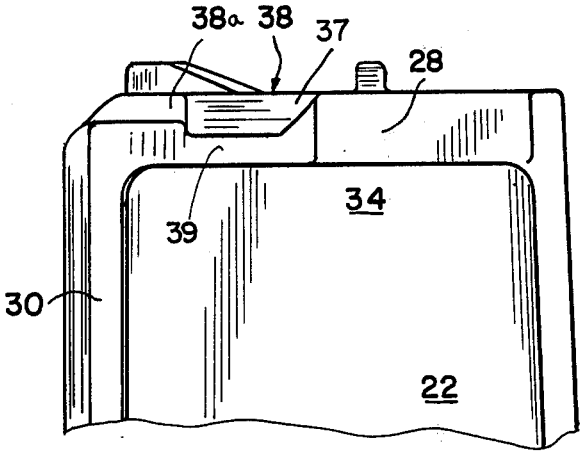
FIG. 4. is a fragmentary end view of the coupler head of FIG. 1.

In accordance with the present invention an upper segment 37 of the leading edge 38 of the top shelf 28 is inclined upwardly and rearwardly toward the car an acute angle a, FIG. 3, extending from a substantially lower vertical surface portion 39 which originates at the lower surface of the shelf. In the illustrated embodiment the angle a is preferably about 35°;however, other angles of inclination for coupler droop may be used. The upper segment 37 is of sufficient length laterally so as to accommodate full overlap of the mating top shelf leading edge for full horizontal angling.

In accordance with yet another feature of the present invention, a forward rib 38*a* on the top shelf 28 provides for extending the upper segment 37 of the leading edge 38 upwardly above the top wall 33 of the top shelf 28 as best shown in FIG. 3.

Figure 6:
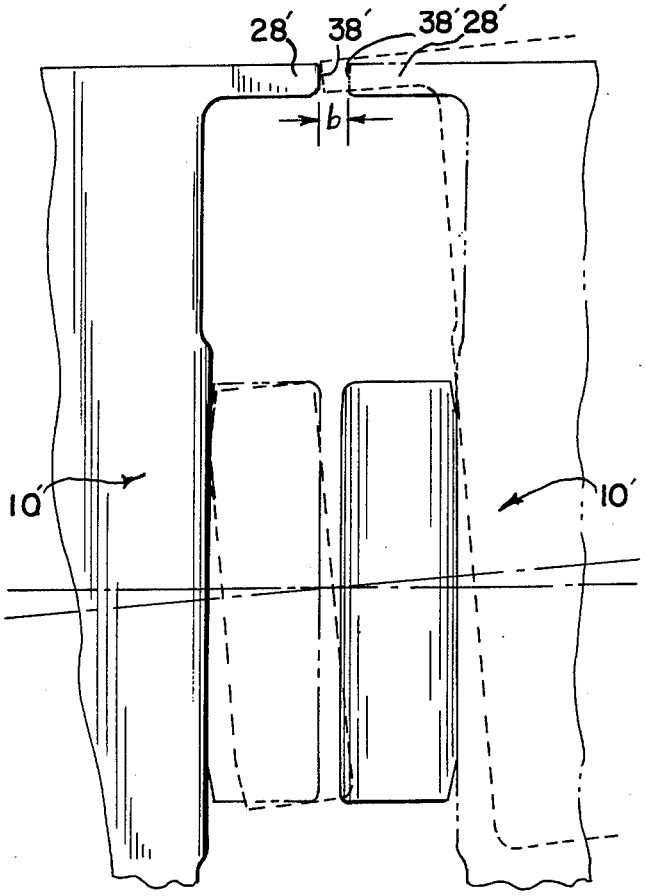
FIG. 6 is a side view, somewhat schematic, representing a known commercial type of "E" coupler in a different operating condition from FIG. 5.

From the above description of an embodiment, the operation of the improved coupler is believed clear. However, briefly, referring first to the schematic representation of an "E" type coupler with a known top shelf, as illustrated in FIG. 6, there is illustrated a mating set of couplers 10' each having a top shelf 28' with substantially vertical front edges 38'. At normal buff position as shown in solid in FIG. 6, there is a clearance b, here shown as 49/64 of an inch, between the leading edges 38' of the top shelves of mating coupler heads 10'. However, when vertical angling takes place, these edges approach each other and at the A.A.R. vertical angle requirement of 4° – 43' they assume the position as indicated by the dash line construction of FIG. 6. Further, as herebefore indicated, the top shelves 28' may approach each other sooner than desired due to the coupler position known as coupler droop. At this coupler droop position there will be a tendency for the top surface of the leading edges 38' to contact before contact is made between the front face of the couplers and knuckles, thereby imposing the initial heavy buff loads on the shelf. This leading edge cannot be moved rearward for additional clearance, because the retention range of the couplers would be reduced.

Figure 5:
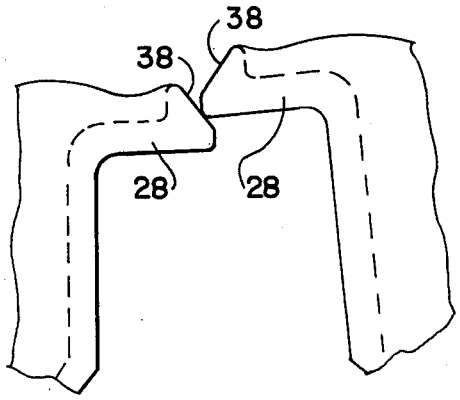
FIG. 5. is a side view, somewhat schematic, of the upper support shelf edges in one operating condition of the "E" type coupler according to the present invention.
Figure 7:
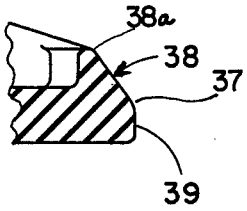
FIG. 7 is a cross sectional view taken along line 7—7 of FIG. 2.

In accordance with the present invention, by inclining the upper segment 37 of the top shelf leading edge 38 upward and rearwardly toward the car, as shown in FIGS. 3 and 5, the retention ability will not change; however, additional clearance for coupler droop is provided, as illustrated in FIG. 5.

Moreover, as is clear from a comparison of FIGS. 6 and 5, the upward extension of the leading edge 38 of the mating couplers also minimizes the tendency of one leading edge slipping under the other during a droop condition of the couplers.

It should be understood that the arrangement herein described constitutes the preferred embodiment and that many adaptations and modifications may be made without departing from the spirit of the invention.

What is claimed is:

1. In combination with a railway car body having a coupler head of the type having upper and lower lugs on one side of the head, a guard arm on the other side of the head, a face between the lugs and the guard arm partially lying in a vertical plane, a knuckle pivotally supported by the lugs and partially lying in a vertical plane, the knuckle and face being spaced from one another when the knuckle is in a closed position to define an opening, the knuckle having an upper and a lower surface, a lower shelf on the head having a surface spaced from and located downwardly below the lower surface of the knuckle, and an upper shelf on the head having a top wall spaced from and located upwardly above the upper surface of the knuckle and having a forward leading edge, the improvement wherein, said leading edge of said upper shelf being divided into a lower vertical surface portion and an upper segment with said upper segment being inclined upwardly and rearwardly toward the railway car at an angle of at least 4°–43' to the vertical, said upper shelf having a forward rib formed on said top wall, and said upper segment of said leading edge extending upwardly above said top wall onto said forward rib.

2. The improvement set out in claim 1 wherein said upper segment of said leading edge being of a sufficient length laterally so as to accommodate full overlap of said top shelf leading edges for full horizontal angling.

* * * * *